US005377428A

United States Patent [19]

Clark

[11] Patent Number: 5,377,428

[45] Date of Patent: Jan. 3, 1995

[54] TEMPERATURE SENSING DRYER PROFILE CONTROL

[75] Inventor: Ralph C. Clark, Ashwaubenon

[73] Assignee: James River Corporation of Virginia, Richmond, Va.

[21] Appl. No.: 120,449

[22] Filed: Sep. 14, 1993

[51] Int. Cl.[6] ..... F26B 3/00

[52] U.S. Cl. ..... 34/446; 34/447; 34/484; 34/561; 34/116

[58] Field of Search ..... 34/48, 46, 4, 41, 443, 34/444, 445, 446, 482, 483, 484, 485, 114–117, 549, 550, 561

[56] References Cited

U.S. PATENT DOCUMENTS

| | | | |
|---|---|---|---|
| 3,040,807 | 6/1962 | Chope | 162/252 |
| 3,293,770 | 12/1966 | Rauskolb | 34/48 |
| 3,720,002 | 3/1973 | Martin | 34/41 |
| 4,202,112 | 5/1980 | von der Eltz et al. | 34/4 |
| 4,494,316 | 1/1985 | Stephansen et al. | 34/68 |
| 4,509,270 | 4/1985 | Stephansen | 34/4 |
| 4,514,913 | 5/1985 | Stephansen | 34/48 |
| 4,590,685 | 5/1986 | Roth | 34/48 |
| 4,594,795 | 6/1986 | Stephansen | 34/68 |
| 4,612,802 | 9/1986 | Clarke et al. | 73/73 |
| 4,701,857 | 10/1987 | Robinson | 34/48 |
| 5,010,659 | 4/1991 | Treleven | 34/41 |

*Primary Examiner*—Denise L. Gromada

*Attorney, Agent, or Firm*—Sixbey, Friedman, Leedom & Ferguson

[57] ABSTRACT

A drying control system and method for obtaining a substantially uniformly dried low moisture content web efficiently with reduced energy usage in a papermaking process is provided. The drying rate of the web in this process is precisely controlled by detecting and monitoring the web or felt low and high cross-direction temperature profiles and then actuating drying rate modulators as required to increase or decrease the drying rate to produce a substantially flat temperature profile in response to temperature profile information provided to an automatically or manually controlled central control system by web high temperature and low temperature sensors.

36 Claims, 8 Drawing Sheets

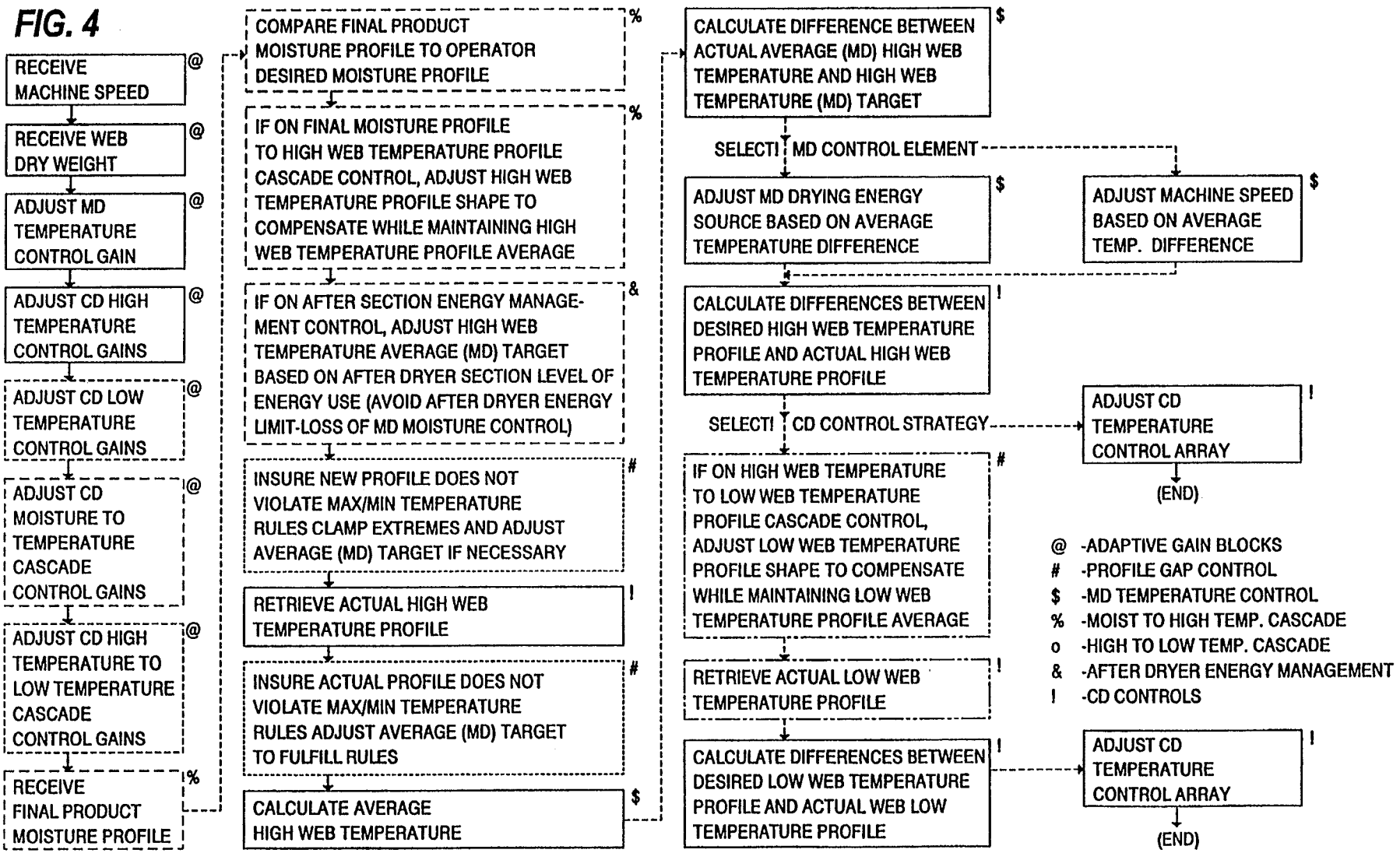
FIG. 4
RECEIVE MACHINE SPEED
RECEIVE WEB DRY WEIGHT
ADJUST MD TEMPERATURE CONTROL GAIN
ADJUST CD HIGH TEMPERATURE CONTROL GAINS
ADJUST CD LOW TEMPERATURE CONTROL GAINS
ADJUST CD TO TEMPERATURE CASCADE CONTROL GAINS
ADJUST CD HIGH TEMPERATURE TO LOW TEMPERATURE CASCADE CONTROL GAINS
RECEIVE FINAL PRODUCT MOISTURE PROFILE
COMPARE FINAL PRODUCT MOISTURE PROFILE TO OPERATOR DESIRED MOISTURE PROFILE
IF ON FINAL MOISTURE PROFILE TO HIGH WEB TEMPERATURE PROFILE CASCADE CONTROL, ADJUST HIGH WEB TEMPERATURE PROFILE SHAPE TO COMPENSATE WHILE MAINTAINING HIGH WEB TEMPERATURE PROFILE AVERAGE
IF ON AFTER SECTION ENERGY MANAGEMENT CONTROL, ADJUST HIGH WEB TEMPERATURE AVERAGE (MD) TARGET BASED ON AFTER DRYER SECTION LEVEL OF ENERGY USE (AVOID AFTER DRYER ENERGY LIMIT-LOSS OF MD MOISTURE CONTROL)
INSURE NEW PROFILE DOES NOT VIOLATE MAX/MIN TEMPERATURE RULES CLAMP EXTREMES AND ADJUST AVERAGE (MD) TARGET IF NECESSARY
RETRIEVE ACTUAL HIGH WEB TEMPERATURE PROFILE
INSURE ACTUAL PROFILE DOES NOT VIOLATE MAX/MIN TEMPERATURE RULES ADJUST AVERAGE (MD) TARGET TO FULFILL RULES
CALCULATE AVERAGE HIGH WEB TEMPERATURE
CALCULATE DIFFERENCE BETWEEN ACTUAL AVERAGE (MD) HIGH WEB TEMPERATURE AND HIGH WEB TEMPERATURE (MD) TARGET
SELECT MD CONTROL ELEMENT
ADJUST MD DRYING ENERGY SOURCE BASED ON AVERAGE TEMPERATURE DIFFERENCE
ADJUST MACHINE SPEED BASED ON AVERAGE TEMP. DIFFERENCE
CALCULATE DIFFERENCES BETWEEN DESIRED HIGH WEB TEMPERATURE PROFILE AND ACTUAL HIGH WEB TEMPERATURE PROFILE
SELECT CD CONTROL STRATEGY
IF ON HIGH WEB TEMPERATURE TO LOW WEB TEMPERATURE PROFILE CASCADE CONTROL, ADJUST LOW WEB TEMPERATURE PROFILE SHAPE TO COMPENSATE WHILE MAINTAINING LOW WEB TEMPERATURE PROFILE AVERAGE
RETRIEVE ACTUAL LOW WEB TEMPERATURE PROFILE
CALCULATE DIFFERENCES BETWEEN DESIRED LOW WEB TEMPERATURE PROFILE AND ACTUAL WEB LOW TEMPERATURE PROFILE
ADJUST CD TEMPERATURE CONTROL ARRAY
(END)
ADJUST CD TEMPERATURE CONTROL ARRAY
(END)
@ -ADAPTIVE GAIN BLOCKS
-PROFILE GAP CONTROL
$ -MD TEMPERATURE CONTROL
% -MOIST TO HIGH TEMP. CASCADE
o -HIGH TO LOW TEMP. CASCADE
& -AFTER DRYER ENERGY MANAGEMENT
! -CD CONTROLS

TEMPERATURE SENSING DRYER PROFILE CONTROL

TECHNICAL FIELD

The present invention relates generally to papermaking drying processes and apparatus for producing paper with a low moisture content and specifically to a control system and process for drying paper which controls the dryer profile by sensing the temperature profile of the paper web during the papermaking process.

BACKGROUND OF THE INVENTION

Some papermaking processes require the drying of the paper web being formed to under three per cent (3%) moisture content at one or more points in the process. The manufacture of paper and paperboard which must be dried to less than 3% moisture content has been accompanied by chronic problems which have adversely affected the efficiency and increased the cost of producing the paper product. Drying a paper or paperboard web to a moisture content of less than 3% requires a high energy input. Heretofore, it was difficult to control drying of a paper or paperboard web to less than 3% moisture in such a way that untoward effects could be avoided, so that the quality of the paper product has not always been consistent or predictable. The present invention effectively controls the drying of a paper web to less than 3% moisture so that energy usage is reduced and the quality of the final product is significantly improved.

During the papermaking drying process a non-uniform drying stress distribution may develop in both the sheet plane direction and in the thickness direction because of non-uniformity in the hydro-thermal and mechanical properties produced in the wire and press sections of the papermaking apparatus and because of the non-uniform moisture and temperature history during drying. Curl, wrinkle, cockle and other results of dimensional instability in the paper drying process are likely to be produced in the finished sheet. It has been recognized that the distribution of drying stress can be altered by exposing the paper web to different drying conditions or "histories" on the top and bottom sides in the after-dryer section of the papermaking process. Although curl shape at the reel can be affected somewhat by this type of differential drying, the basic dimensional instabilities created in a moving paper web by non-uniform drying stress have not been eliminated from the final product. Nari et al recognized the critical nature of and demand for dimensional stability in a wide variety of paper types and investigated the relationship between the hygroexpansion coefficient and drying shrinkage in papers made form mechanical pulps in *Tappi Journal*, Vol. 76, No. 6 (June 1993), finding that low drying shrinkages for some mechanical pulps were caused by low moisture changes rather than a low hygroexpansion coefficient.

The presence of uneven cross-direction drying rates induces mechanical stresses in the paper sheet during the papermaking process. When the paper sheet is dried under tension this stress is "locked in" as different parts of the sheet shrink and dry at different places, rates and times during the process. This physical stress can be released by rewetting so that a repeatedly rewetted and redried paper sheet with varying cross-direction stress areas is highly likely to display such adverse effects as baggy edges, cockles, soft centers and hard centers which detract significantly from the paper quality. An effective control system for a papermaking drying process would effectively eliminate these problems.

The drying of paper and paperboard consumes large quantities of energy and accounts for much of the cost of the finished product. Accordingly, a great deal of work has focused on reducing the energy consumed in drying by measuring the moisture profile in the web and then modulating the amount of drying energy supplied to various strips of the web to achieve a match between the amount of energy supplied to each longitudinal strip in the web and the moisture content of that strip. These methods obtain a relatively flat moisture profile in the sheet with a reduced expenditure of energy. Even though such methods seem to achieve significant reductions in energy consumption, they typically overdry the web which produces adverse effects in the finished paper product.

The prior art has disclosed a wide variety of systems and methods for drying moving paper webs during production to desired dryness specifications. U.S. Pat. Nos. 4,494,316 to Stephansen et al; and 4,509,270; 4,514,913 and 4,594,795 to Stephansen for example, all disclose systems for drying moving paper webs. These cross-direction web dryers are designed to reduce the moisture content of the web. U.S. Pat. No. 4,514,913 measures the web moisture profile and relocates dryer modules over the worst moisture streaks in the moving web.

U.S. Pat. No. 4,590,685 to Roth discloses an apparatus for uniformly drying a paper web to a desired moisture content which includes a manual or automatic control system responsive to the web moisture content. Spaced parallel drying units are regulated by the control system between low and high flame conditions to resolve narrow moisture streaks in the cross web direction. U.S. Pat. No. 3,293,770 to Rauskolb also discloses a radiant heat web dryer that is adjustable in response to web moisture levels to vary the drying, effects. The sheet material drying system disclosed in U.S. Pat. No. 3,720,002 to Martin uses a combination of radiant heat and heated gas to dry a wet web, depending on the web moisture content.

The use of the web moisture content as a control parameter for optimum paper drying has not proved to be an ideal solution to the aforementioned problems. The available web moisture measuring equipment has often produced misleading or inaccurate information, which has resulted in the overdrying of the web. In papermaking processes requiring low web moisture contents, particularly moisture contents of less than 3%, web overdrying can easily produce a degraded paper product.

The prior art has proposed dryer systems useful in sheet manufacturing processes which use control parameters other than moisture content as a basis for controlling the drying energy applied to the sheet. U.S. Pat. No. 4,612,802 to Clarke et al, for example, discloses a method and apparatus for determining the moisture content of a thin wood sheet by monitoring the variations in the rise and fall of the sheet surface temperature after the sheet has been heated. However, there is no suggestion that this method could be used to control drying in a papermaking process to produce optimal drying when the paper moisture content is less than 3%.

The dryer control system disclosed in U.S. Pat. No. 4,701,857 to Robinson monitors two temperatures, that of the sheet product being dried and that of the drying medium, and determines what the final moisture content will be. The temperature differential or sheet speed is then controlled to obtain the desired final moisture content. This control system, which is more suitable for wood products than for paper sheets, does not use the temperature profile of the sheet itself as a basis for optimizing drying of the sheet to a moisture content of about 3% with a minimum expenditure of energy.

U.S. Pat. No. 5,010,659 to Trelevan discloses an infrared drying system which monitors the moisture content, temperature or other physical property at selected zone positions along the width of a traveling web. Infrared heating lamps are controlled and energized by a computer control system in response to the selected physical property. The moisture content or other physical property of the web is sensed at only one location of the web in this system, and it is not suggested that optimization of drying to a low web moisture content of 3% by obtaining a web temperature profile could be accomplished with this system.

The prior art, therefore, has failed to provide a papermaking process drying control system or method which monitors the web cross-direction temperature profile of the paper web to optimize drying of the web to a low moisture content of about 3% at low energy usage which is not accompanied by the adverse effects in the final product produced by uneven drying. A need exists for such a system and method.

SUMMARY OF INVENTION

It is a primary object of the present invention, therefore, to overcome the disadvantages of the prior art and to provide a papermaking process drying control system and method which monitors the web temperature profile to optimize drying to low moisture contents of about 3% and less.

It is another object of the present invention to provide a papermaking process drying control system and method which obtains optimal drying to 3% or less moisture at reduced energy usage.

It is a further object of the present invention to provide a papermaking process drying control system and method which allows the manipulation of cross direction temperature control to produce a substantially flat temperature profile.

It is still another object of the present invention to provide a papermaking process drying control system and method which reduces the stress to which the paper web is subjected during formation.

It is a still further object of the present invention to provide a papermaking process drying control system and method which avoids localized overdrying of the web.

It is yet another object of the present invention to provide a papermaking process drying control system and method which evens out size press pick-up.

It is yet a further object of the present invention to provide a papermaking process drying control system and method which alleviates non-uniformities which degrade the uniformity of caliper of the finished paper product.

An additional object of the present invention is to provide a drying control system which may be placed in a location from which the web being dried is not visible.

The aforesaid objects are achieved by providing a papermaking process drying control system and method adaptable for use with a conventional papermaking machine which forms and then dries a wet web of paper to a low moisture content of about 3% prior to translation of the web to a take up reel. The drying control system includes a cross-direction drying means controllable to modify the temperature across the web, temperature detection means for determining the cross-direction temperature profile of the web, and modulation means for controlling the cross-direction drying means in response to variations in the temperature profile to produce an optimally uniform cross-direction temperature profile. The temperature detection means includes a high temperature detection means positioned where at least a portion of the web can have a temperature above the boiling point of water and, optionally, a low temperature detection means located where an entire cross-direction strip of the web will be at a temperature below the boiling point of water. Drying rate prediction means are further included to predict the drying rate of the web as a function of observed temperature in locations proximate to the low temperature detection means. The modulation means is responsive to signals from both the high and low temperature detection means to produce a substantially uniform cross-direction web temperature profile near the high temperature detection means. The drying control method of the present invention produces a substantially fiat, uniform cross-directional profile by detecting the cross-direction web temperature, monitoring the cross-direction temperature profile as the web is dried, and controlling the rate of drying the web to insure that the web temperature is maintained at a substantially uniform optimum temperature and flat cross-directional profile.

Additional objects and advantages will be apparent from the following description, claims and drawings.

BRIEF DESCRIPTION OF THE DRAWINGS

FIG. 4 is a block diagram of the control logic of a preferred embodiment of the papermaking process drying control system and method of the present invention;

DESCRIPTION OF THE PREFERRED EMBODIMENTS

Figure 1:
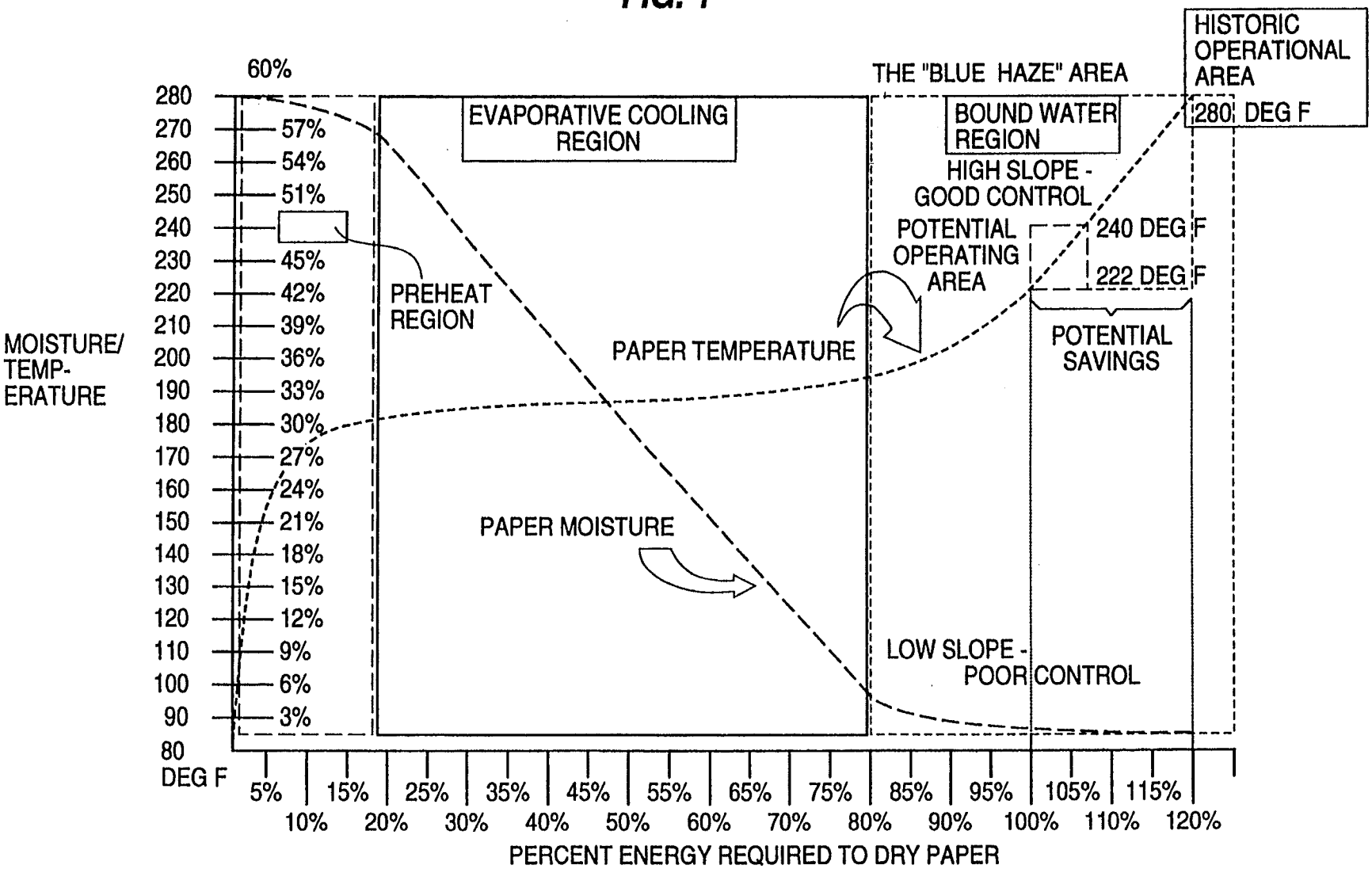
FIG. 1 is a graphic representation of the relationship between paper moisture and temperature during drying.

Paper drying is one of the most energy-intensive portions of the papermaking process. The energy required to dry a paper web, particularly to low moisture contents near 3%, represents a major component of the cost of manufacturing the paper, which is usually borne by the paper end user. Reduction of the quantity of energy currently required to produce very dry paper webs could produce both very substantial energy savings and a concomitant reduction in the pollution which accompanies such energy consumption.

The moisture and temperature history of the web as it is brought to the final moisture content by the papermaking process affects both the dimensional stability and coatability of the paper and, thus, the quality of the paper product. Paper that has not been dried uniformly across the web or in the cross-direction may curl at the edges or ripple in the middle, which is unacceptable. To avoid or compensate for nonuniform drying, most papermaking machine operators apply excessive amounts of heat in an effort to dry the sheet quickly and minimize nonuniform drying as much as possible. However, this practice consumes large quantities of energy and does not guarantee an acceptable product since the paper is usually overdried. The available web moisture control systems, while allowing the production of an improved product, have not been entirely successful in either eliminating the effects of nonuniform drying or reducing energy usage for the drying process.

The energy-intensive method of making paper currently employed in this country and elsewhere is not completely understood. In a typical papermaking process wood pulp is pumped as a water slurry containing about 0.5% solids onto a moving wire table or Fourdrinier screen, where most of the water is removed from the slurry to concentrate the solids. This is typically accomplished by the application of a vacuum and running the fibrous solids through a series of rollers which cause the wood fibers to form a cohesive mat or web. The web passes through a series of steam-heated drying stages, calender rolls, coating processes and other operations until the finished paper, which has a typical moisture content of about 4 to 8%, is rolled up on a take-up roll. However, during drying and calendering steps, the moisture control often drops to as low as 1 to 3%. The successful formation of a high quality finished paper web depends, in large measure, on the precise control of the consistency of the slurry, the rate of deposition of the slurry onto the screen, and the uniformity of the drying process. Of these parameters, effecting uniform drying of the paper web is perhaps the most poorly understood and controlled in the papermaking process.

The energy required to reduce the moisture content of a paper web during formation to below 3% can be substantial. The removal of sufficient water to produce a moisture content of about 1% or less is both difficult and expensive, although papermaking processes are often run to produce about 1% moisture in an attempt to control the process. This approach might permit the sheet to be dried as much as possible before coating or sizing so that the end product is acceptable. However, because the drying process is not, in fact, responsive to precise controls, the paper web is not dried uniformly and, hence, may not pick up sizing or coating materials uniformly. The end result is often a paper product with dimensional problems.

As discussed above, the approach of the prior art to control drying during the papermaking process to produce a substantially uniformly dry sheet has been to monitor the moisture profile of the paper web. However, adjusting the papermaking process parameters in response to a sensed moisture profile has provided neither the precise control nor the uniform paper product desired. The inventor of the present invention has discovered that a papermaking process drying control system and method which senses and monitors the web cross-direction temperature profile and uses this temperature profile data as a basis for controlling the drying process to produce a uniformly dried, high quality paper product with significantly less energy usage than prior art processes. An additional benefit of this invention is that the temperature detecting means may be placed in a location in which the temperature of either the web itself or the felt may be detected, provided, of course, that the felt and web have had some time to reach equivalent temperatures. It was found that in many commercial machines, the paper web cross-direction temperature profile is not constant. Unlike the typical cross-direction moisture content, which is often essentially flat, the temperature profile is very nonuniform. FIGS. *7a* and *7b* show profiles measured on commercial machines. Why this temperature differential, which can be as great as 40° F., exists is not known. However, the differential is apparent shortly after the drying process begins and becomes more marked as the web proceeds to the take-up reel.

This uneven temperature profile has been found to contribute to such problems as nonuniform size or coating pick-up and dimensional instability. It has been shown that the hotter paper areas pick up less sizing and dry to a lower moisture content than the cooler areas of the paper. The thermal profile of the paper going into the size press must be uniform to insure uniform pick up of the sizing. When the finished paper product produced by a process with a nonuniform thermal profile is wound on a take-up reel, the center typically winds tighter than the ends. This dimensional instability was thought to be caused by nonuniform web caliper, but in fact results from elongation due to nonuniform drying while under tension. The edges of the web dry faster than the center, which is promoted by the manner in which the web is restrained on the papermaking machine, and produces the tightly wound center and "baggy" edges on the web as it is would on the take-up reel.

The papermaking process drying control system of the present invention employs several techniques to produce an array or table of values that represent the surface temperature in predetermined cross direction zones on a moving paper web. The term "paper" as used throughout is intended to encompass all types of papers and paperboards of the weights typically made on a wet process paper machine of the type described herein. The predetermined cross direction zones should be symmetrical in size and constant in their cross web positions. Different types of thermometry instrumentation, preferably in combination with control or computer systems, may be used to detect, monitor and present the necessary web temperature information. The web temperature data obtained by the drying control system of the present invention is used as a basis for the automatic or manual control of actions required upstream in the drying process to reduce drying energy usage and improve the quality of the paper product.

This approach allows feedback control for both the web average temperature control, which is a machine direction control, and the zonal temperature control, which is a cross directional control.

Referring to the drawings, FIG. 1 is a graphic representation of the general relationship between paper moisture and temperature during drying in a papermaking process. When the paper is dried to below a 3% moisture content, the drying rate of unit water removed per unit of energy used becomes a decreasing return, which provides a poor, low slope for moisture control. The right side of the graph evidences this. Minor moisture changes under these circumstances require large steam changes. When this is combined with the traditional operating mode which is set to produce very dry paper, the steam setpoint is then run at excessively high values. It is also evident from FIG. 1 that when the paper moisture is below 3%, the paper temperature increases rapidly with the input of each additional unit of energy. The slope of this curve provides a good control gain, and precise control can be easily achieved. The good control response makes it possible to lower the temperature setpoint, which both saves energy and reduces the stress the paper must survive while maintaining a stable sheet for downstream processes. Below 3% moisture, the paper temperature is more sensitive to weight, ash and speed changes than is the paper moisture. Consequently, the paper temperature is a better indictor of machine upsets in these process parameters, and they can be more effectively monitored and corrected.

The improvement will be essentially the factor of the ratio of the slopes of paper moisture and paper temperature on the FIG. 1 graph. The slope of web temperature change versus a drying energy change is typically ten times the slope of moisture change versus a drying energy change in the machine regions where the web temperature exceeds 230° F. This enhances the performance of a closed loop feedback based on web temperature. Moreover, web temperature is the predominant parameter to indicate the state of the web in the same 230° F. and above region because the vast majority of the free or unbound water has evaporated, and there is very little moisture to measure. Since the web temperature is the inversely coupled result of the amount of moisture left in the web, as the moisture signal diminishes, the temperature rises quickly because there is no more evaporative cooling taking place.

Therefore, moisture control provides a generally poor control response with diminished visibility because of poor signal to noise ratios for traditional sensors. Papermaking machine operators have traditionally pushed for stability of the web into coaters and size presses by driving the moisture levels ever lower. This, however, has worsened the temperature effects.

Figure 2:
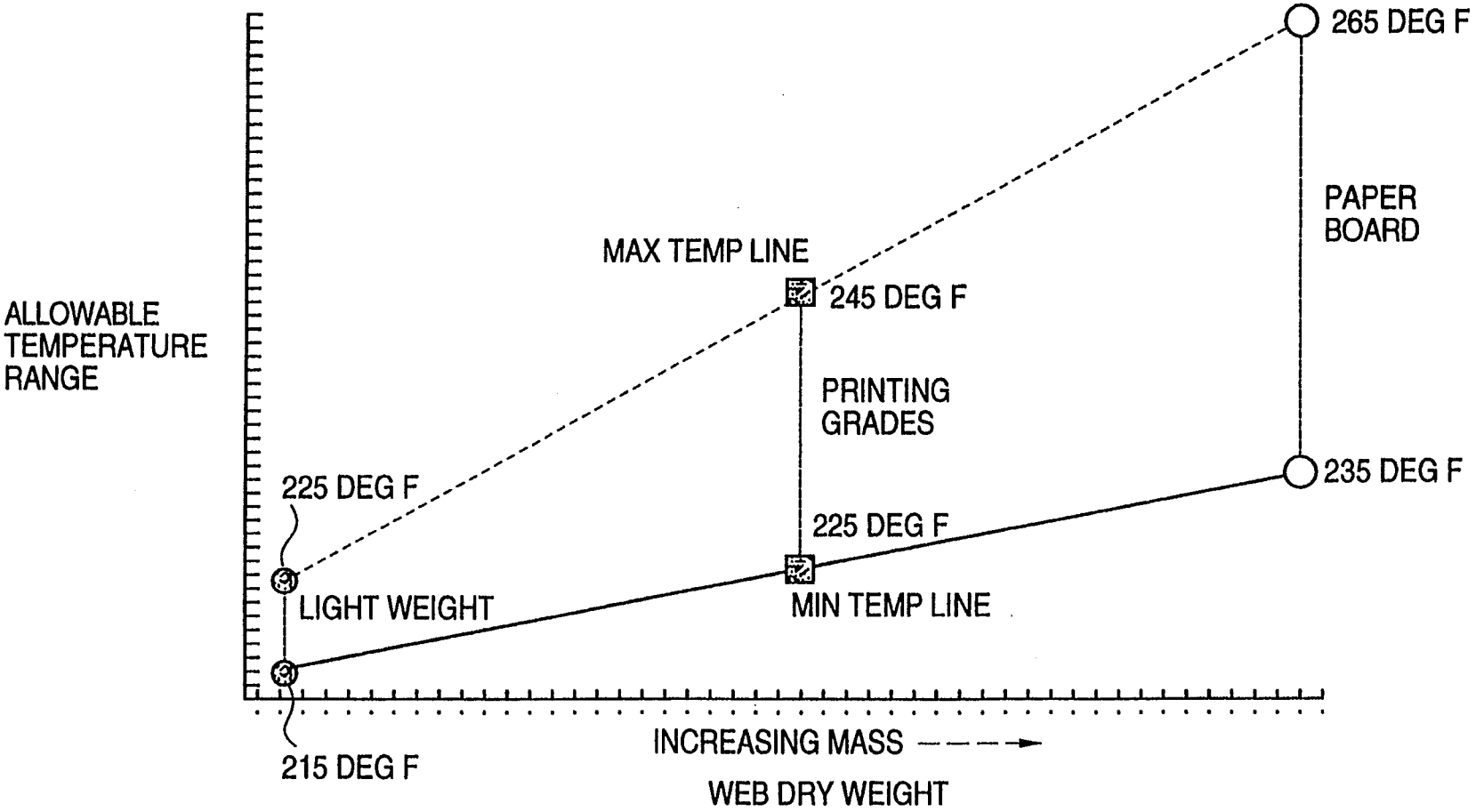
FIG. 2 is a graphic representation of the relationship of web dry weight to allowable temperature range.

FIG. 2 illustrates the relationship of web dry weight to the allowable optimum temperature range for different types of paper. As the web dry weight or paper mass increases from light weight paper to paperboard, the difference between the minimum and maximum drying temperatures required for optimum drying of the paper web also increases. Light weight papers, for example, tolerate only about a ten degree range of optimum minimum and maximum drying temperatures, while paperboard has about a thirty degree allowable optimum temperature range. Consequently, the capability for precisely controlling the paper web cross-direction temperature profile in accordance with the present invention allows the papermaking machine operator to control precisely the minimum and maximum temperature parameters for the specific paper being produced.

Figure 3:
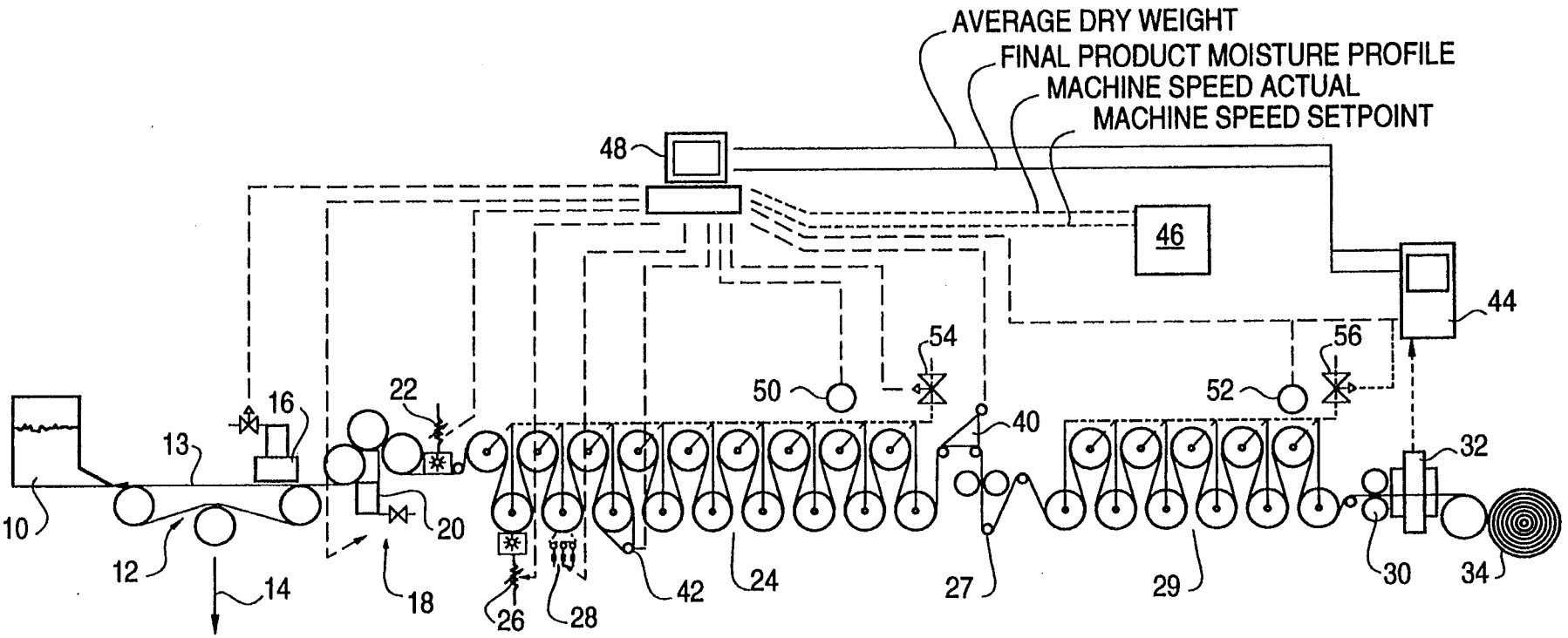
FIG. 3 is a schematic, illustration of a conventional papermaking machine showing the integration of the papermaking process drying control system of the present invention into a conventional papermaking process along with several suitable temperature modulators located in a variety of locations.

FIG. 3 is a schematic representation of a papermaking machine layout which incorporates the drying control system of the present invention. The drying control system of the present invention includes a high web temperature profiling scanner and a low web temperature profiling scanner. A series of shower arrays and heater arrays are located in positions to increase or decrease the drying rate in response to the web temperature profile for optimal drying. Information relating to the weight, moisture and caliper measure of the final product, the machine speed and steam energy usage is provided to a computer operated control system so that the machine speed and energy usage can be controlled as required to produce a substantially uniformly dried web. Typically no single commercial paper machine would include all of the temperature modulators 16, 20, 22, 26 and 28 shown in FIG. 3. However, since a wide variety of types of temperature modulators are usable in various locations, several different types of temperature modulators are shown at suitable locations.

In the paper machine layout of FIG. 3, a slurry of papermaking fibers from the headbox 10 is deposited on a forming wire or wire table 12, and water is drawn off in the direction of the arrow 14. A controllable profiling steam shower array 16 is positioned at the downstream end of the wire table across the width of the web 13 to increase the drying rate as required to maintain a substantially flat temperature profile in response to a signal from a central control system. By this point in the process the paper has increased to about 30% solids from about 0.5% solids as the paper enters the press section 18. A second controllable profiling steam shower array 20 can be actuated by the central controller to increase the drying rate, as required, in the press section. A controllable profiling infrared heater array 22 can also be actuated by the central control system if needed to increase the drying rate even more. The web leaving the press section 18 and entering the main dryer section 24 is about 40% solids. A main dryer section controllable profiling infrared heater array 26 can be actuated by the central control system to further increase the drying rate. actuated by the central control system to further increase the drying rate. A main dryer section controllable profiling re-wet water shower array 28 may be actuated by the central control system to decrease the drying rate as required to maintain an optimum flat temperature profile for the kind of paper being produced. As the paper web 13 travels through the main dryer section, water vapor is driven out of the paper web or sheet so that the sheet leaves the main dryer section 24 and enters the size press 27 at about 98% solids.

In the size press 27 water is added to the dried sheet surface in the form of a coating of a sizing material. The sized sheet then enters the after dryer section 29 where it is dried to a desired finished moisture content. The dried sheet is directed through a calendar stack 30. Downstream of the calendar stack a weight, moisture and caliper scanner 32 scans the calendared sheet, which is then wound on a take-up reel 34 as a finished paper product.

The central control system obtains information about cross-direction and machine direction process parameters and adjusts these parameters as required to maintain a substantially flat cross-direction temperature profile to produce a uniformly dry sheet with minimal energy usage. The cross-direction temperature profile of the sheet is scanned in two locations to obtain the high web or sheet cross-direction temperature and the low web cross-direction temperature. The high web temperature is measured after the sheet has exited the main dryer section 24 and before it has entered the size press 27. The high temperature at this location should be above the boiling point of water. The high web temperature measurement is made by a temperature scanner 40. The low web temperature is preferably measured early in the main dryer section 24 after the web has passed the rewet water shower array 28 by a temperature scanner 42. The low temperature at this location should be below the boiling point of water.

The central control system also includes a final web weight and moisture control system 44, which obtains information from the weight, moisture and caliper scanner 32. Indicators 50 and 52 indicate the steam energy usage of the main dryer section 24 and the after dryer section 29, respectively, and provide energy usage information. All of this information, along with information from the high and low web temperature profiling scanners 40, 42 and information from a speed control system 46 is provided to a central control system computer 48. This information is processed by the control computer 48, and various process steps are adjusted as required to increase or decrease the drying rate to produce a substantially uniformly dried high quality finished paper product with less energy than has heretofore been necessary when the moisture profile served as the basis for drying the paper web. The dashed lines and arrows in FIG. 3 represent the flow of information to the central control system computer 48 and from the central control system computer to the various showers, heaters and steam boxes that provide the energy for drying or modulate the drying rate of the sheet. For example, if the web cross-direction temperature profile generated by the temperature scanners 40 and 42 indicates that the drying rate should be increased, the central control computer 48 will activate one or more of the steam shower arrays 16 and 20 or the infrared heater arrays 22 and 26 to increase the drying of the corresponding section of the web. If the temperature profile indicates that the drying rate should be decreased, the re-wet water shower array 28 in the main dryer section 24 will be activated to cool the corresponding web secion and decrease the drying rate.

FIG. 4 sets forth the control strategy used by the central control system to maintain an optimum cross-direction temperature profile in a paper web formed on a papermaking machine with a drying control system designed in accordance with the present invention. An objective of the present drying control system is to manipulate the web cross-direction temperature to produce a flat temperature profile. A flat temperature profile is the direct result of controlling the drying rate so that the paper web is dried evenly. An even drying rate, which is expressed as the loss of moisture versus time/energy input, is crucial to the production of a high quality web.

The central control computer 48, the web speed control system 46 and the web final weight and moisture control system 44 are all integral components of this control strategy, as are the high and low web temperature profiling scanners 40 and 42. The drying control system of the present invention receives information relating to the papermaking machine speed from the web speed control system 46 and information relating to the web dry weight from the final weight and moisture control system 44. In accordance with this information the machine direction (MD) temperature control gain is adjusted, and the cross-direction (CD) high and low temperature control gains are adjusted. The cross-direction moisture to temperature cascade control gains are adjusted. The cross-direction high temperature to low temperature cascade control gains are also adjusted, and a final product moisture profile is received from the control system 4,4. This final product moisture profile is compared to the operator desired moisture profile.

If the system is on the final moisture profile to high web temperature profile cascade control, the high web temperature profile shape is adjusted to compensate while a high web temperature profile average is maintained. However, if the system is on the after section energy management control, the high web temperature average machine direction target is adjusted based on the after dryer section level of energy use as indicated by indicator 52 (FIG. 3). An after dryer energy limit should be avoided to avoid the loss of machine direction moisture control.

The control system next insures that the new temperature profile does not violate the minimum/maximum temperature parameters for the type of paper being produced. Exemplary temperature maxima and minima for three different paper types are set forth in FIG. 2. The extreme temperatures are clamped, and the average machine direction target is adjusted, if necessary.

The actual high web temperature is retrieved from the high temperature profiling scanner 40, and the central control system computer 48 determines whether the actual temperature profile violates the maximum/minimum temperature rules or requirements. The average machine direction target is adjusted as required to fulfill the requirements. The actual high web temperature is then calculated, and the difference between the machine direction actual average high web temperature and the machine direction high web temperature target is calculated. Based on this information a machine direction control element is selected. Alternatively, the machine direction drying energy source 54 (FIG. 3) for the main dryer section 24 is adjusted based on the average temperature difference, or the machine speed control system 46 is adjusted based on the average temperature difference.

The differences between the desired high web temperature profile and the actual high web temperature profile are calculated, and an appropriate cross direction control strategy is selected. The cross direction temperature control arrays 16, 20, 22, 26 and 28 can be adjusted, individually or collectively as required, to increase or decrease the web drying rate in response to the cross-direction web temperature profile. However, if the control system is of the optimal configuration having high web temperature to low web temperature profile cascade control, the low web temperature profile shape is adjusted to compensate while maintaining the low web temperature profile average. The actual low web temperature profile is retrieved from the low web temperature profiling scanner 42, and the differences between the desired low web temperature profile and the actual low web temperature profile are calculated. The cross-direction temperature control arrays 16, 20, 22, 26 and 28 are adjusted as required to increase or decrease the drying rate of the web.

The cross-direction temperature control arrays 16, 20, 22, 26 and 28 are positioned at typical locations along the papermaking machine to permit optimal control of the drying rate, increasing or decreasing it as needed to maintain the optimum high web temperature profile and the optimum low web temperature profile. Typically in a commercial machine only one or two of these temperature control arrays would be provided, but several are indicated here to illustrate the wide variety of suitable apparatus types and locations. These temperature control arrays may include two steam shower arrays 16 and 20, located at the wire table 14 and in the press section 18, respectively, which can be actuated by the temperature control system computer 48 to increase the web drying rate at these locations. The temperature control arrays 22 and 26 are infrared heater arrays, but may be other types of heating arrays suitable for the environment, and are located, respectively, in the press section 18 and in the main dryer section 24. These temperature control arrays may be activated by the present temperature control system as required to increase the drying rate of the web at these locations. The temperature control array 28 is a re-wet shower water shower array which decreases the web drying rate if the differences between the actual and desired web temperature profile necessitate a decrease in the drying rate. All of the temperature control arrays are preferably positioned upstream of the low web temperature profiling scanner 42.

Figure 5:
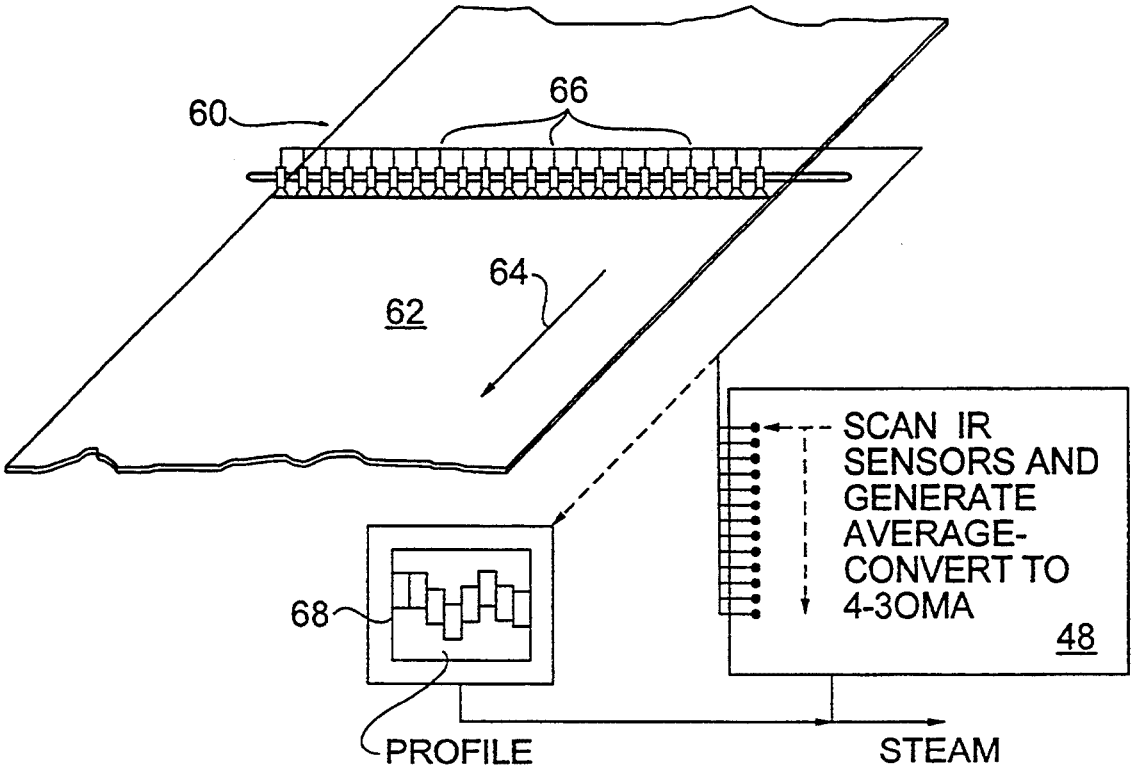
FIG. 5 is a schematic representation of one type of temperature detection means which includes multiple cross-direction sensing elements.
Figure 6A:
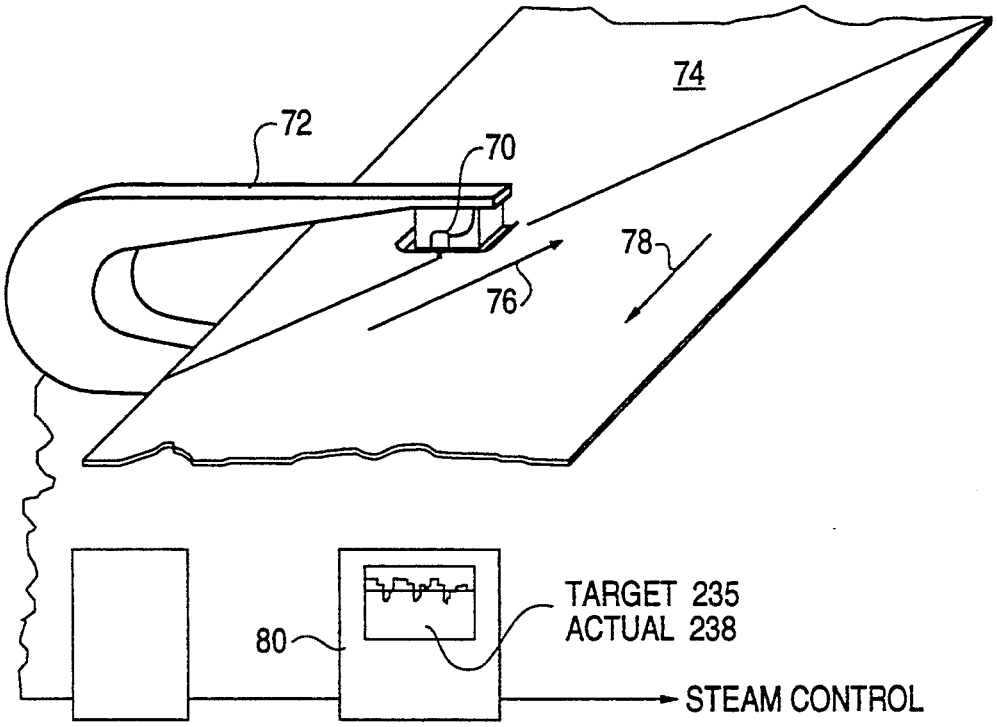
FIGS. 6*a* and 6*b* are schematic representations of two types of temperature detection means wherein a single sensor scans the cross-direction of the web from a single location.
Figure 6B:
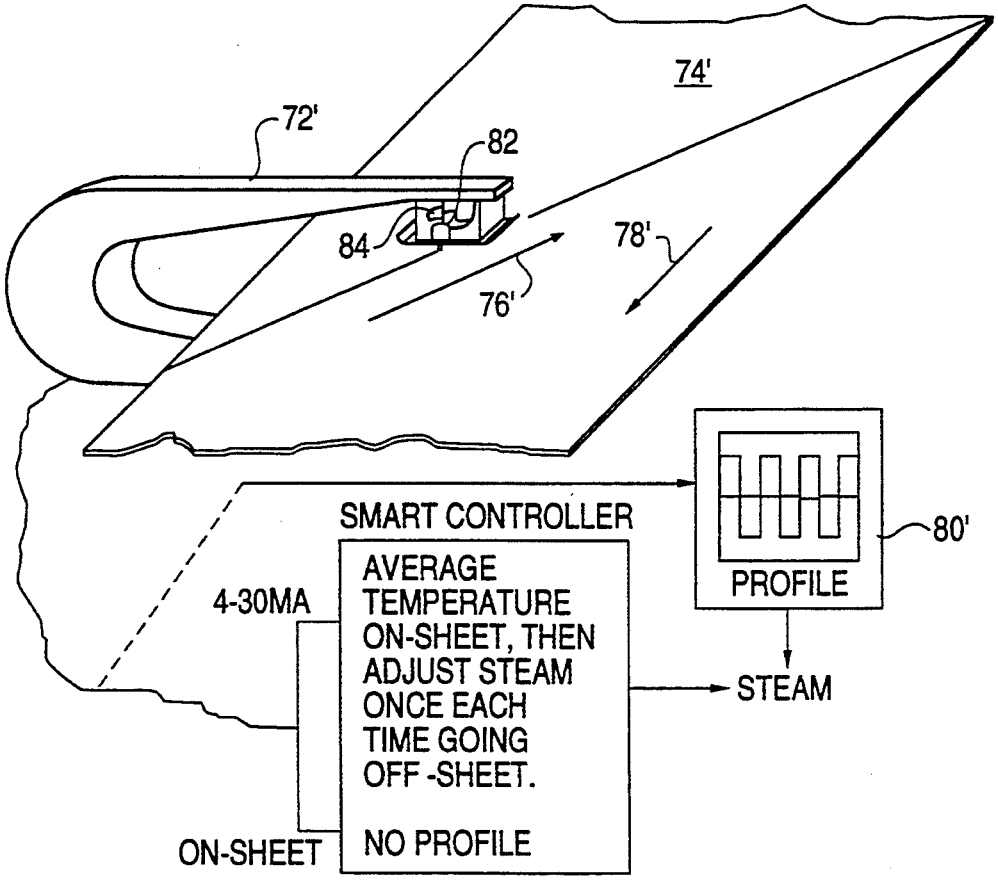

The high and low web temperature profiling scanners 40 and 42 can have any of several possible configurations. Whatever specific equipment is chosen must be capable of acquiring an array or table of values which represent the surface temperature in predetermined cross-direction zones on a moving paper web. The zones should be symmetrical in size and have a constant cross web position. The preferred technology for this purpose is infrared thermometry. FIGS. 5, 6a and 6b illustrate suitable types of cross-direction temperature sensing and monitoring apparatus useful with the papermaking drying control system and method of the present invention.

FIG. 5 is a schematic representation of a cross-direction temperature sensing element 60 mounted, usually by a fixed mounting element, across a moving paper web 62 perpendicular to the machine direction, arrow 64, of the papermaking process. This type of temperature sensing element includes a plurality of infrared thermocouples 66, each of which obtains web surface temperature information for a corresponding optically defined web zone. The web temperature information obtained is presented graphically, typically in the form of the temperature profile shown in the graph 68, which represents the actual web temperature profile. This data is provided to the temperature control system computer 48 as described above in connection with the FIG. 4 web temperature control strategy.

FIGS. 6*a* and 6*b* illustrate the modification of scanning apparatus currently used in many papermaking processes to obtaining such processing information as moisture content with temperature sensing elements to obtain web cross-direction temperature profile data. In these embodiments a single element infrared thermometer is mounted in two different ways on a conventional scanning mechanism, such as those supplied under the Accuray name by Asea, Brown, Boveri which traverses the entire breadth of the web. FIG. 6*a* shows this type of scanning mechanism with an infrared sensor 70 added to the movable scanning arm 72. The infrared sensor 70 traverses the moving web 74 perpendicularly, resulting in a diagonal scan of the moving web 74 extending diagonally in the direction of arrow 76 so that the entire breadth of the web is scanned. The machine direction is shown by arrow 78. Web temperature profile information 80 is provided to the temperature control system computer 48 so that the necessary steps can be taken to increase or decrease the web drying rate to conform the actual web temperature. FIG. 6*b* shows essentially the same scanning apparatus as in FIG. 6*a*. However, the scanning arm 72' has been modified to receive an infrared sensor 82 and a sheet detector 84 in a "piggy back" arrangement. A web or sheet temperature profile 80' is generated accordingly.

The temperature data and profiles obtained by the selected type of sensing apparatus forms the basis for decisions by the temperature control system to modify parameters of the papermaking drying process, automatically or manually, to produce a high quality paper product with reduced energy usage. The impact of these modifications, which typically occur upstream of the location of the high and low web temperature profiling scanners can be demonstrated by the data collected by the devices shown in FIGS. 5, 6*a* and 6*b*. This permits feedback controls for both the web average temperature control, which is a machine direction control, and the zonal temperature control, which is a cross-directional control. Any type of temperature sensing apparatus which achieves these objectives may be employed in the papermaking drying control system of the present invention. The kinds of temperature sensing elements which use infrared thermometry have been found to be especially suitable. However, other types of thermal sensing devices which will withstand the papermaking environment and which may be integrated into the control systems as described above may also be used. A preferred type of infrared temperature scanner can be integrated into either an open-loop monitoring system or closed-loop control system to provide maximum flexibility for controlling the papermaking process.

The temperature of either the paper web or the felt supporting the paper web can be sensed by the devices shown in FIGS. 5, 6*a* and 6*b*. This is in distinct contrast to prior an papermaking process drying control systems which rely on moisture sensors to control the drying process. These prior art moisture sensing processes must be able to "see" the paper to accurately sense the moisture content. Locating the moisture sensors in positions where the paper surface is readily "seen" usually cannot be done conveniently in most paper machine configurations.

Figure 7A:
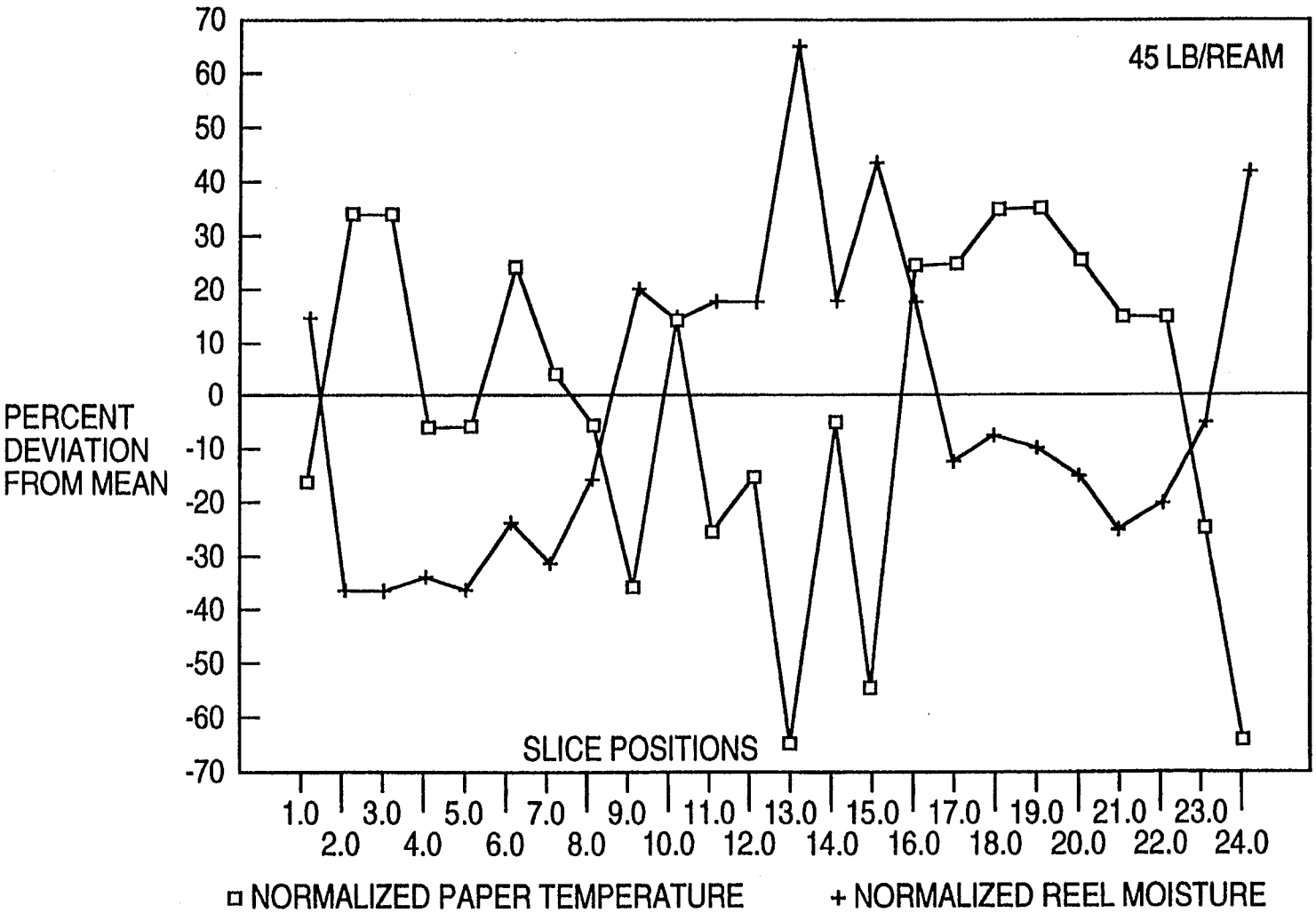
FIGS. 7*a* and 7*b* are graphic representations of the relationships between normalized paper temperature and normalized reel moisture for two weights of paper.
Figure 7B:
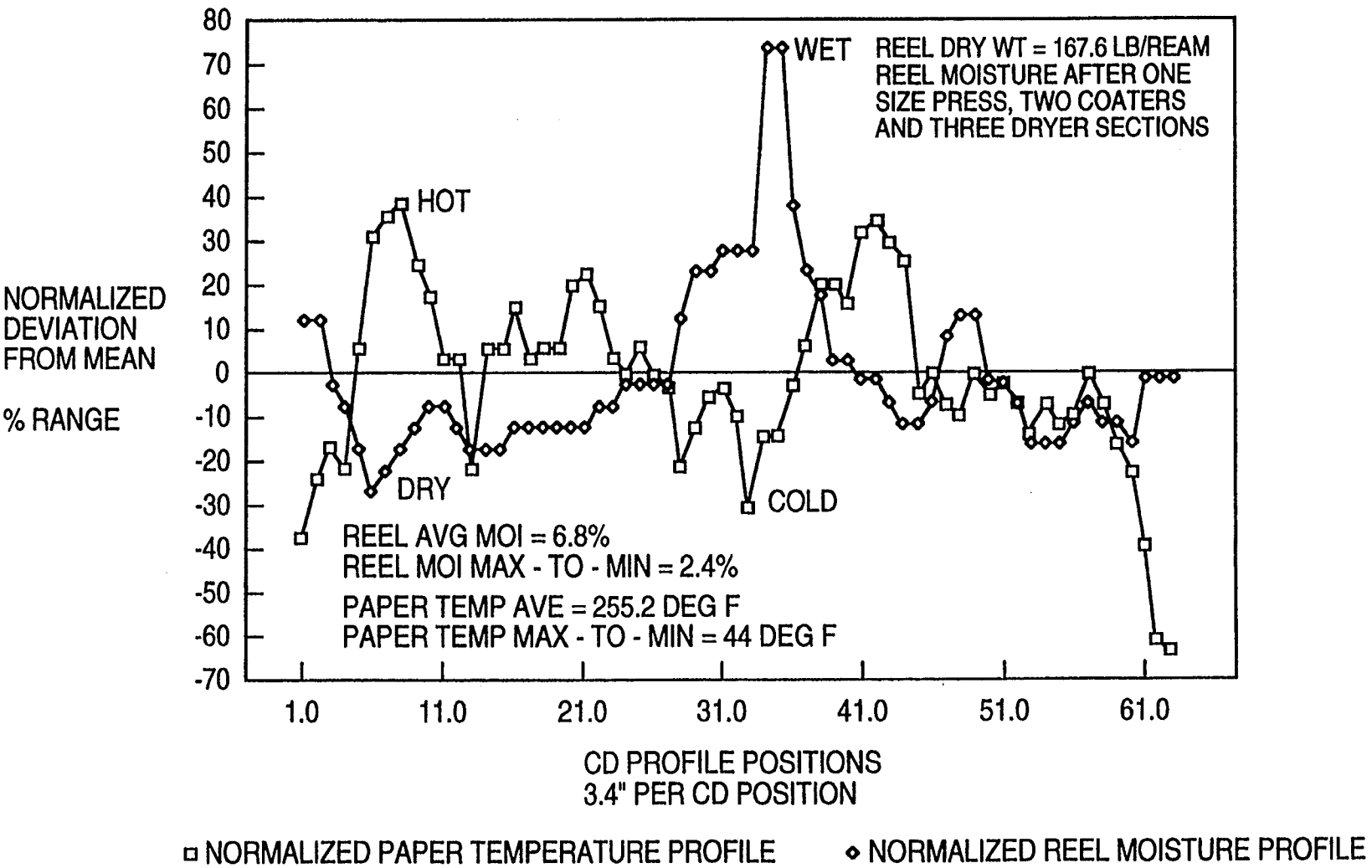

The cross-direction web temperature profiles have been monitored for many different papermaking processes to arrive at operating parameters that will produce a high quality paper product at less than 3% moisture with less energy than has heretofore been required. FIGS. 7*a* and 7*b* present, graphically, normalized paper temperature and reel moisture for two such processes. The reel moisture profile, which is produced by data obtained downstream of the temperature measurement, the size press, the cross direction profiling rewetting shower, the after dryer section and the calendar stack, is the inverted image of the pre-size press temperature profile. FIG. 7*a* shows profiles for a papermaking process for forming a 45 lb/ream paper product. The reel profile displayed in FIG. 7*a* is indicative of a moisture problem, which was discovered to arise from the existence of a hot zone on the second dryer section bottom felt. This problem was solved by the inclusion of the re-wet water shower array 28 (FIG. 3) to lower the felt temperature. This produced an improvement in the reel moisture profile and a 1% increase in moisture. The pre-size press temperature profile relationship to reel moisture profile appears to be universal for all types of papermaking processes. FIG. *7b* also illustrates the final paper sheet moisture at the reel as compared to the pre-size press temperature profile. The paper produced according to the FIG. *7b* process is a 167.6 lb/ream paper. The front side dry area and mid-section wet area still exist in the finished paper web in the same cross-direction positions where they started as a temperature defect. The drying control system of the present invention prevents such temperature defects from being locked into the web. With the present control system temperature defects are detected early in the process, and the web drying rate is increased or decreased as required to produce a substantially flat, uniform temperature profile.

Figure 8:
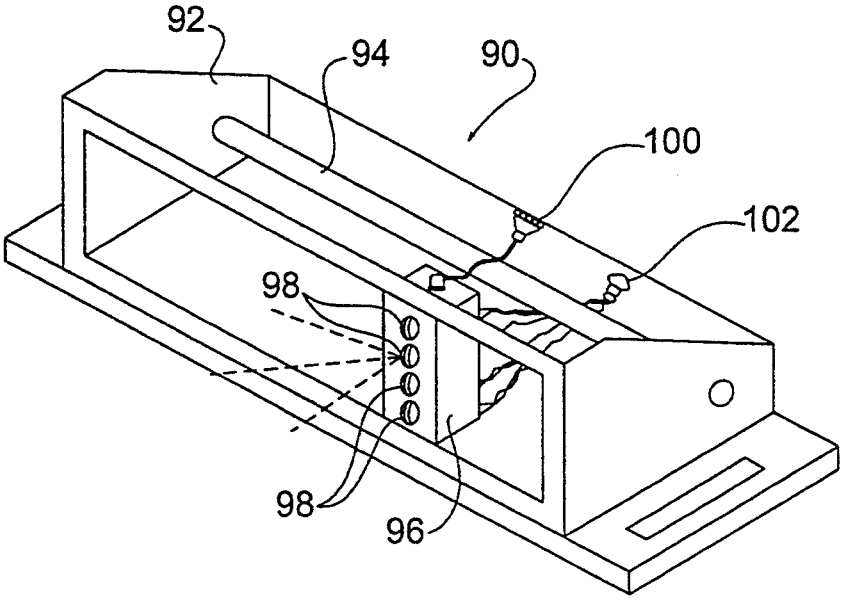
FIG. 8 is a schematic perspective view of one of many suitable types of drying rate modulator or temperature modifying elements useful in the papermaking process drying control system of the present invention.

FIG. 8 is a schematic representation of one kind of a drying rate modulator, which is a re-wet water shower useful for decreasing the web drying rate in response to a detected cross-direction temperature in excess of the predetermined maximum. This apparatus could be used for the shower array 28 in FIG. 3 to wet the felt supporting the web, thus cooling the felt and the paper web. Alternatively, the web could be wet directly. Other controllable water spray systems, such as the moisture-spray cross-direction controller for papermaking systems from VIB Systems of Tucker, Ga., could also be used, however.

The re-wet water shower 90 of FIG. 8, which is preferably mounted at the upstream end of the main dryer section 24 as shown in FIG. 3, includes a housing 92 that extends across the entire breadth of the web. A water header 94 provides water to a nozzle block 96, in which are mounted several nozzles 98. These nozzles are preferably solenoid operated and controlled by the central control computer 48 to spray a corresponding web section as needed to decrease the drying rate. Each nozzle 98 should be capable of providing a water spray of a different capacity for more precise control of the reduction of web temperature and the drying rate. For example, the four nozzles 98 in FIG. 8 each have a respective capacity of 0.017, 0.025, 0.033 and 0.050 gallons per minute and can be selectively activated as required to decrease the web drying rate. Connectors 100, 102 which allow the water and nozzle solenoid valves, respectively, to be quickly disconnected are preferably provided.

When two drying sections are used in a papermaking process, such as the main dryer section 24 and the after dryer section 29 in FIG. 3, and these dryer sections are separated by a rewetting process, such as a size press section 27, the average energy input to the main dryer section can be modulated based upon the energy consumption of the after section. In such a system the high temperature profile detector 40 is typically used to maintain the exit temperature within a selected band. The energy consumption of the after dryer section could be controlled by conventional apparatus. However, the control system and method of the present invention uses the after dryer section 29 energy consumption indicated by indicator 52 as input to modulate the "window" allowed around the temperature profile of the paper sheet leaving the main dryer section 24. To illustrate, if the energy consumption of the after dryer section 29 reaches its maximum limit, the present control system and method will increase the "lower sill" of the window allowed around the exit temperature profile of the sheet as it leaves the main dryer section 24. As a result, energy can be supplied to the web at locations where it is most likely to be effective and efficient. Usually, the energy is most efficiently targeted to the main dryer section 24 by activating energy source 54 as compared to supplying energy to the after dryer section 29 by activating energy source 56 (FIG. 3).

The papermaking process drying control system of the present invention is designed to produce a substantially uniformly dried finished paper sheet with a moisture content of about 3% or less. When the sheet moisture content is above about 3 to 4%, the evaporative cooling effect affects the web temperature profiles so that they do not accurately reflect the web surface temperatures. At low moisture, however, the system of the present invention provides a high quality paper product without the uneven drying and moisture defects characteristic of prior art processes.

INDUSTRIAL APPLICABILITY

The papermaking process drying control system and method of the present invention will be applicable to any papermaking process for producing low moisture content paper. Existing paper/web monitoring systems can be modified to include the temperature sensing and monitoring elements described herein to provide optimum control over the papermaking drying process to produce low moisture content finished papers efficiently with low energy usage.

I claim:

1. A drying control system for a papermaking process adaptable for use with a conventional papermaking machine which forms and then dries a wet web of paper to about a 3% moisture content, wherein said control system includes:

(a) a cross-direction drying means controllable to modify the temperature across the web;

(b) temperature detection means for determining a cross-direction temperature profile of the web;

(c) modulation means for controlling the cross-direction drying means in response to variations in the temperature profile to reduce variations in the cross-direction temperature profile; and (d) central control means for controlling said cross-direction drying means and said modulation means in response to said temperature profile received from said temperature detection means to produce a substantially uniformly dried web.

2. The drying control system described in claim 1, wherein said temperature detection means includes a high temperature detection means positioned where at least a portion of the web has a temperature above the boiling point of water to detect a high web temperature and a low temperature detection means positioned where at least a portion of the web has a temperature below the boiling point of water to detect a low web temperature.

3. The drying control system described in claim 2, further including drying rate prediction means for predicting the drying rate of said web as a function of observed temperature in locations proximate to the low temperature detection means.

4. The drying control system described in claim 1, wherein said modulation means comprises a plurality of web drying rate modulator means for varying the web drying rate in response to the cross-direction temperature profile.

5. The drying control system described in claim 4, wherein said web drying rate modulator means is a cross-direction array of heating elements actuatable by said central control means to increase the drying rate of the web.

6. The drying control system described in claim 4, wherein said web drying rate modulator means comprises a plurality of nozzle spray means for directing a cooling spray across said web actuatable by said central control means to decrease the drying rate of the web.

7. The drying control system described in claim 1, wherein said temperature detection means is positioned to detect the temperature of the web to determine the cross-direction temperature profile of the web.

8. A method of controlling drying in a papermaking process to produce a substantially uniformly dried paper web with a moisture content of about 3% with efficient energy usage including the steps of:

(a) detecting the cross-direction temperature of the web at high and low temperature locations to produce a cross-direction web temperature profile;

(b) providing the temperature profile to a central control means; and (c) adjusting the drying rate of the web as required to produce a substantially flat cross-direction temperature profile.

9. The method of controlling drying described in claim 8, wherein said central control means varies the drying rate as necessary to produce a substantially flat temperature profile.

10. The method of controlling drying described in claim 9, wherein said central control means actuates one of a plurality of cross-direction heating elements as required to raise the temperature in a portion of the web where the drying rate must be increased to flatten the temperature profile.

11. The method of controlling drying described in claim 9, wherein said central control means actuates a cross-direction drying rate modulating element to lower the temperature in a portion of the web where the drying rate must be decreased to flatten the temperature profile.

12. The method of controlling drying described in claim 9, further including the steps of obtaining and providing information related to the web final weight, moisture and caliper to said central control means and adjusting the drying rate of the web as required to correspond to the desired weight, moisture and caliper for the paper web being produced.

13. A drying control system for a papermaking process wherein a wet web of paper is formed from a slurry of papermaking fibers, dried by at least one drying apparatus to a moisture content of about 3% or less, and the final paper product is wound on a take up reel, comprising (a) high temperature detection means for detecting a cross-direction temperature profile of the web at a location where at least a portion of the web will have a temperature above the boiling point of water;

(b) low temperature detection means for detecting a cross-direction temperature profile of the web at a location where, during drying, an entire cross-direction strip of the web will have a temperature below the boiling point of water;

(c) drying rate modulating means for varying the drying rate of the web as required in response to the web cross-direction temperature profiles detected by said high and low temperature detection means;

(d) weight and moisture scanner means for detecting the weight and moisture of the final paper product;

(e) final weight and moisture control system means for receiving information from said weight and moisture scanner means; and (f) central control system means for receiving information from said high and low temperature detection means and said final weight and moisture control system means and processing said information to control said drying rate modulating means to maintain the cross-direction temperature profile of said web within predetermined temperature parameters for the weight of the final paper product.

14. The drying control system described in claim 13, further including speed control system means for driving the speed of said papermaking process interfaced with said central temperature control system means whereby the papermaking process speed is regulated in response to the product parameters of said final paper product.

15. The drying control system described in claim 13, wherein said drying rate modulating means is located upstream of said low temperature detection means in said papermaking process.

16. The drying control system described in claim 15, wherein said drying rate modulating means comprises a plurality of individually controllable cross-direction arrays of temperature modifying means for varying the temperature of a cross-direction zone of said web in response to a signal from said central temperature control system means.

17. The drying control system described in claim 16, wherein at least one of said plurality of individually controllable cross-direction arrays is a profiling steam shower array controllable to increase the drying rate in response to a signal from said central temperature control system means.

18. The drying control system described in claim 16, wherein at least one of said plurality of individually, controllable cross-direction arrays is a profiling infrared heater array controllable to increase the drying rate in response to a signal from said central temperature control system means.

19. The drying control system described in claim 16, wherein at least one of said plurality of individually controllable cross-direction arrays is a profiling re-wet shower array controllable to decrease the drying rate in response to a signal from said central temperature control system means.

20. The drying control system described in claim 16, wherein said high temperature detection means is located downstream of said low temperature detection means.

21. The drying control system described in claim 1, wherein said temperature detection means comprises a single sensor element which scans the width of said web.

22. The drying control system described in claim 1, wherein said temperature detection means comprises a plurality of sensor elements and each of said sensor elements scans a corresponding zone in the cross-section of said web.

23. The drying control system described in claim 13, wherein each of said high temperature detection means and said low temperature detection means comprises a single sensor element which scans the width of said web.

24. The drying control system described in claim 13, wherein each of said high temperature detection means and said low temperature detection means comprises a plurality of sensor elements and each of said sensor elements scans a corresponding zone in the cross-direction of said web.

25. The drying control system described in claim 1, wherein said central control means is automatically controllable to control said drying means and said modulation means to maintain a substantially flat cross-direction temperature profile in said paper web during drying.

26. The drying control system described in claim 13, wherein said central control means is automatically controllable to control said drying rate modulating means to maintain a substantially flat cross-direction temperature profile.

27. The method of controlling drying described in claim 8, further including the step of establishing minimum and maximum temperature parameters based on the weight of the paper formed in the papermaking process and maintaining said substantially flat cross-direction profile within said minimum and maximum temperature parameters.

28. The drying control system described in claim 1, wherein said temperature detection means is positioned to detect the temperature of a felt supporting the web to determine the cross-direction temperature profile of the web.

29. A method of controlling drying in a papermaking process to produce a substantially uniformly dried paper web with a moisture content of about 3% with efficient energy usage including the steps of:

(a) detecting the cross-direction temperature of a felt supporting the web at high and low temperature locations to produce a cross-direction web temperature profile;

(b) providing the temperature profile to a central control means; and (c) adjusting the drying rate of the web as required to produce a substantially flat cross-direction temperature profile.

30. The method of controlling drying described in claim 29, wherein said central control means varies the drying rate as necessary to produce a substantially flat temperature profile.

31. The method of controlling drying described in claim 30, wherein said central control means actuates one of a plurality of cross-direction heating elements as required to raise the temperature in a portion of the web where the drying rate must be increased to flatten the temperature profile.

32. The method of controlling drying described in claim 30, wherein said central control means actuates a cross-direction drying rate modulating element to lower the temperature in a portion of the web where the drying rate must be decreased to flatten the temperature profile.

33. The method of controlling drying described in claim 30, further including the steps of obtaining and providing information related to the web final weight, moisture and caliper to said central control means and adjusting the drying rate of the web as required to correspond to the desired weight, moisture and caliper for the paper web being produced.

34. The drying control system described in claim 1, wherein said central control means is manually controllable to control said drying means and said modulation means to maintain a substantially flat cross-direction temperature profile in said paper web during drying.

35. The drying control system described in claim 13, wherein said central control means is manually controllable to control said drying rate modulating means to maintain a substantially flat cross-direction temperature profile.

36. The method of controlling drying described in claim 29, further including the step of establishing minimum and maximum temperature parameters based on the weight of the paper formed in the papermaking process and maintaining said substantially flat cross-direction profile within said minimum and maximum temperature parameters.

* * * * *